US010259016B2

(12) United States Patent
Philippe et al.

(10) Patent No.: US 10,259,016 B2
(45) Date of Patent: Apr. 16, 2019

(54) METHOD OF MERGING POSTAL ARTICLES WITH ALREADY-SORTED MAILPIECES ON A TABLE

(71) Applicant: SOLYSTIC, Bagneux (FR)

(72) Inventors: Agnes Philippe, Vincennes (FR); Bruno Volta, Gif sur Yvette (FR)

(73) Assignee: SOLYSTIC, Bagneux (FR)

( * ) Notice: Subject to any disclaimer, the term of this patent is extended or adjusted under 35 U.S.C. 154(b) by 0 days.

(21) Appl. No.: 15/574,202

(22) PCT Filed: Jul. 7, 2017

(86) PCT No.: PCT/FR2017/051863
§ 371 (c)(1),
(2) Date: Nov. 15, 2017

(87) PCT Pub. No.: WO2018/029405
PCT Pub. Date: Feb. 15, 2018

(65) Prior Publication Data

US 2018/0236497 A1 Aug. 23, 2018

(30) Foreign Application Priority Data

Aug. 12, 2016 (FR) ..... 16 57734

(51) Int. Cl.
*B07C 7/00* (2006.01)

(52) U.S. Cl.
CPC ..... *B07C 7/005* (2013.01); *B07C 2301/0083* (2013.01)

(58) Field of Classification Search
CPC ..... B07C 7/00; B07C 7/005
USPC ..... 209/552, 603, 630
See application file for complete search history.

(56) References Cited

U.S. PATENT DOCUMENTS

| | | | | |
|---|---|---|---|---|
| 6,692,091 | B2 * | 2/2004 | Mulaw | A47B 63/00 108/61 |
| 2003/0160052 | A1 * | 8/2003 | Mulaw | A47B 63/00 220/532 |
| 2006/0113362 | A1 * | 6/2006 | Kara | B07C 3/008 229/120.02 |
| 2015/0117702 | A1 * | 4/2015 | Volta | B07C 7/005 382/101 |
| 2015/0266063 | A1 * | 9/2015 | Caillon | B07C 3/00 382/101 |
| 2017/0203335 | A1 * | 7/2017 | Benyoub | B07C 7/005 |

FOREIGN PATENT DOCUMENTS

| | | | | |
|---|---|---|---|---|
| DE | 10 2010 043389 | A1 | 5/2012 | |
| DE | 102010043389 | A1 * | 5/2012 | B07C 3/00 |
| FR | 3 023 736 | A1 | 1/2016 | |
| FR | 3023736 | A1 * | 1/2016 | B07C 7/005 |
| WO | 2015/001206 | A1 | 1/2015 | |
| WO | WO-2015001206 | A1 * | 1/2015 | B07C 7/005 |

* cited by examiner

*Primary Examiner* — Terrell H Matthews
(74) *Attorney, Agent, or Firm* — Ware, Fressola, Maguire & Barber LLP

(57) ABSTRACT

A method of merging, on a table (7), postal articles (2) with mailpieces (3) that are already sorted into a certain sorting order comprises the steps of pre-sorting the postal articles (2) in a sorting frame having vertical slots by means of an electronic station for assisting with sorting in the sorting frame, and then in using said station again for assisting the operative with merging the pre-sorted postal articles with the mailpieces.

2 Claims, 3 Drawing Sheets

METHOD OF MERGING POSTAL ARTICLES WITH ALREADY-SORTED MAILPIECES ON A TABLE

CROSS REFERENCE TO RELATED APPLICATIONS

This application is the U.S. National Stage of International Application Number PCT/FR2017/051863 filed on Jul. 7, 2017, which application claims priority under 35 USC § 119 to French Patent Application No. 1657734 filed on Aug. 12, 2016. Both applications are hereby incorporated by reference in their entirety.

TECHNICAL FIELD

The invention relates to the field of postal sorting.

The invention relates more particularly to a method of manually merging postal articles with mailpieces that are already machine-sorted into a certain sorting order, e.g. into the order of the delivery round or "postman's walk".

Such postal articles are, particularly but not exclusively, non-machine-sortable postal articles, i.e. postal articles that cannot currently be sorted automatically in sorting machines. Such postal articles could also be mailpieces that are machine-sortable but that it has not been possible to machine sort.

PRIOR ART

Postal sorting machines and methods used for preparing delivery rounds can be fully automatic, or else they can include steps in which it is necessary for an operative to intervene, in particular for handling non-machine-sortable postal articles.

A method is known from Patent Document DE 10 2010 043 389 for merging non-machine-sortable postal articles with machine-sorted mail. In that known method, merging assistance is given to the operative in charge of performing the merging.

That assistance consists in displaying on a display screen placed next to the operative the image of a reference mailpiece that should precede or that should follow the postal article to be merged, in the ordered sequence of the mailpieces.

For this purpose, a camera is used to form a digital image of the postal article to be merged, and, on the basis of the data contained in said image, the destination of said postal article is determined. Then, the reference mailpiece is determined on the basis of the mailpiece data produced in the sorting machine during the preceding sorting passes performed on the mailpieces, and on the basis of a sorting plan that corresponds to the ordering of said mailpieces in the sequence, and on the basis of the destination of the postal article to be merged.

Then the operative scans through the sequence of mailpieces until said operative visually identifies the reference mailpiece, whereupon said operative can insert the postal article at the right place in the ordered sequence of the mailpieces.

That type of manual merging in preparing the delivery round requires going back and forth between the front and the back in the stack of mailpieces so as to insert each postal article at the right place, which increases the risk of error during the merging.

SUMMARY OF THE INVENTION

An object of the invention is therefore to remedy those drawbacks.

To this end, the invention thus provides a method of merging, on a table, postal articles with mailpieces that are already sorted, said method being characterized in that it comprises the following steps:

- placing the mailpieces in a stack and on edge on a merge table;
- placing the postal articles to be merged in a stack and flat on a deck of an assistance electronic station for assisting with manual sorting, which station comprises a camera disposed overlying the deck, a display screen, and a monitoring/control unit;
- causing the monitoring/control unit of the station to operate in such a manner that, before each time a postal article is taken from the top of the stack of postal articles, a digital image of said article is formed by the camera, and, on the basis of said image, the unit produces, on the display screen, a first marker signal that designates a vertical slot in a sorting frame having vertical slots, into which slot said postal article is to be inserted;
- when the vertical slots of the sorting slot are filled with postal articles, taking a bundle of postal articles, as a handful, from the sorting frame, and placing it in a stack and flat on the deck of the assistance electronic station for assisting with manual sorting; and
- causing the monitoring/control unit of the station to operate in such a manner that, before each time a postal article is taken from the top of the stack of postal articles, a digital image of said article is formed by the camera, and, on the basis of said image, the unit produces, on the display screen, a second marker signal that is representative of an insertion position in the stack of mailpieces on the merge table, at which position said postal article is to be inserted.

The basic idea of the invention consists, in this example, in simplifying preparation of the delivery round and in improving the ergonomics of the work station of the sorting operative.

The method of the invention advantageously enables the deck of the assistance electronic station for assisting with manual sorting, the camera, and the monitoring/control unit to be reused so that, at the same work station of a sorting operative, it is possible both to pre-sort the postal articles into a frame having vertical slots, and also to merge the pre-sorted postal articles with the stack of already-sorted mailpieces on a table. The method of the invention also makes it possible for the frame-sorting passes to be performed upstream using the same equipment.

It can thus be understood that the sorting operative has, within easy reach, the sorting frame, the merge table, and the deck of the assistance electronic station, thereby improving the ergonomics of the work station.

Advantageously, the deck of the assistance electronic station for assisting with manual sorting, the camera, and the monitoring/control unit may form a moving unit that can be moved between the sorting frame and the merge table.

Reusing the equipment also limits the installation costs by using a "passive" sorting frame not having any electronics, and reduces the footprint.

In addition, since the method of the invention is simpler than the known method, the operative can optimize occupancy of the frame having vertical slots and can free up time for which other operatives can use the frame.

The idea of the invention also consists in making merging postal articles with the stack of mailpieces more intuitive, and in improving checking for handling errors made by the operative.

To this end, a stack of postal articles is created specifically for the merge from the pre-sorted postal articles in the slots of the frame. The postal articles of said stack are disposed flat on the deck of the assistance electronic station in a pre-sorted state that corresponds to the order of the already-sorted mailpieces.

Thus, it can be understood that the operative no longer needs to go back and forth between the front and the back of the stack of mailpieces in order to merge the postal articles. In other words, the operative looks for the insertion position in the stack of mailpieces without ever going back along the stack. By obviating the need to go back and forth in the stack, sorting errors are thus limited.

It can also be understood that inserting a plurality of ordered postal articles from the stack at the same insertion position removes the risk of ambiguity and of error by the operative.

Marking the postal articles to be merged and the mailpieces that are already sorted then becomes unnecessary during merging on a table.

Each time an article is placed in the stack of mailpieces, a sequence check can be performed for detecting any handling error by the operative.

Taking the postal articles from the frame in handfuls also makes it possible to reduce handling errors by the operative.

BRIEF DESCRIPTION OF THE DRAWINGS

The present invention can be better understood and other advantages appear on reading the following description and on examining the accompanying drawings, in which.

DESCRIPTION OF AN IMPLEMENTATION

Figure 1:
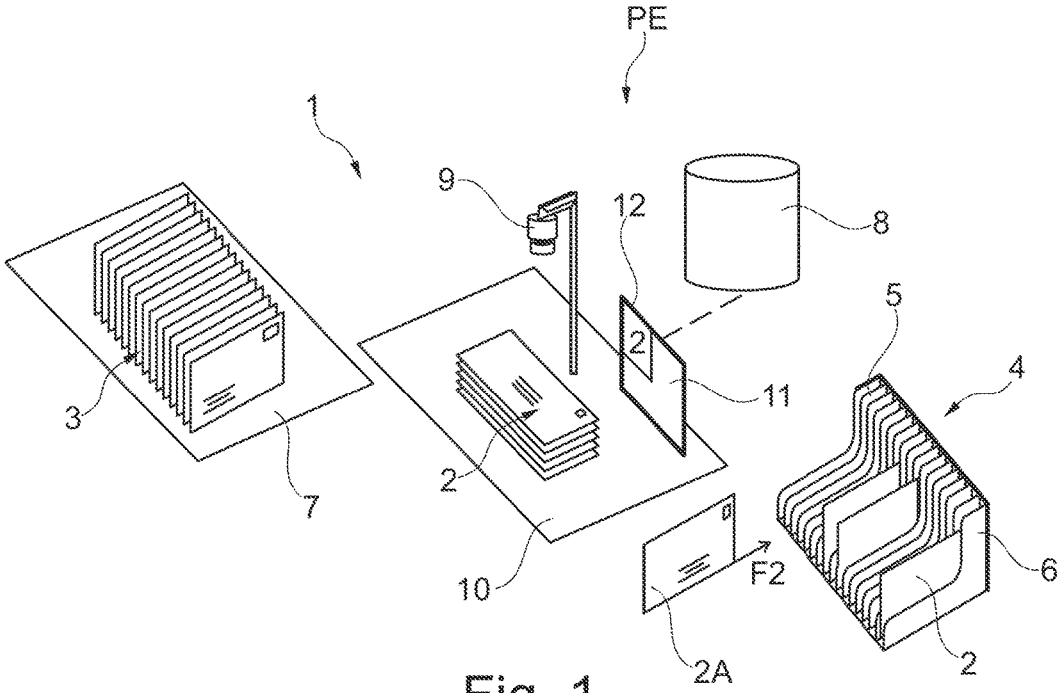
FIGS. 1 to 4 diagrammatically show apparatus for assisting in merging for performing the merging method of the invention.

FIGS. 1 to 4 are highly diagrammatic views of apparatus 1 for assisting in merging postal articles 2, in particular non-machine-sortable articles, with a stack of mailpieces 3 that are already sorted into a certain sorting order, e.g. into the order of the delivery round.

For example, the mailpieces 3 are letters, magazines, or other flat postal articles that are machine-sortable, i.e. that can be sorted automatically in a postal sorting machine, as is well known to the person skilled in the art.

In this example, the apparatus 1 for assisting in merging includes a sorting frame 4 having vertical slots 5, each of which is suitable for receiving a postal article 2 on edge.

The vertical slots 5 succeed one another in mutually parallel manner between two distal ends of the frame 4 along its long length, and the frame has separating walls 6 for separating adjacent slots that extend in planes perpendicular to the long length of the frame. In the example shown in FIGS. 1 to 4, the separating walls 6 are L-shaped in the respective planes perpendicular to the long length of the frame so that the slots are open both over the front face and over the top face of the frame.

Figure 2:
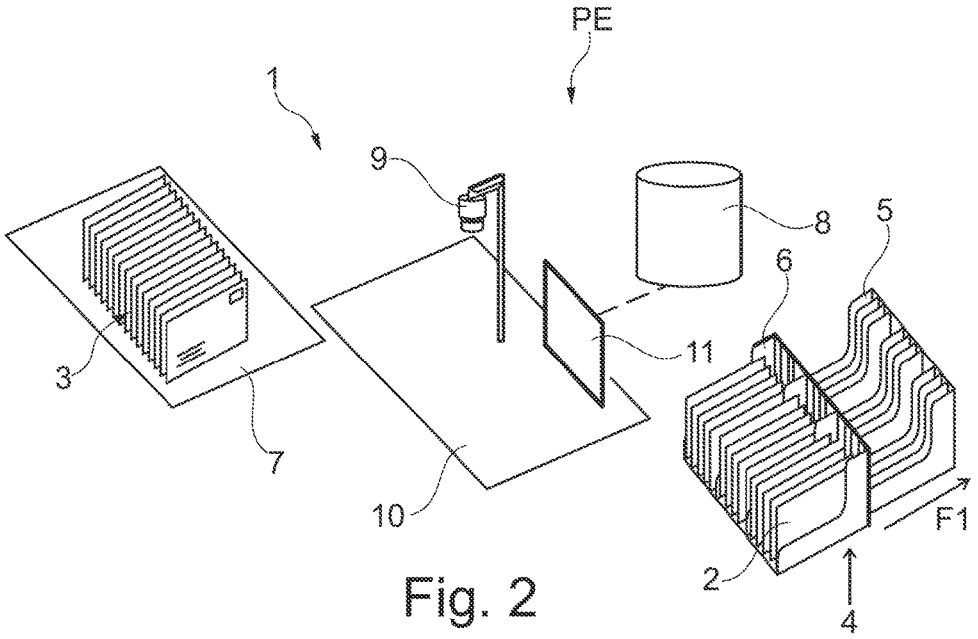

In a particular embodiment of the apparatus for assisting in merging of the invention, some walls 6 of the frame may be designed to be retractable at regular intervals along the succession of the walls 6, and, as shown in FIG. 2, some walls may slide towards the back of the frame 4 in the direction indicated by arrow F1, while other walls at regular intervals remain fixed, thereby defining bundles of articles between the fixed walls, each of which bundles can be taken from the frame as a handful.

The apparatus 1 for assisting in merging also includes a merge table 7 on which already-sorted mailpieces 3 are disposed in a stack and on edge.

In accordance with the invention, in order to facilitate merging the postal articles 2 with the mailpieces 3, the apparatus 1 for assisting in merging further includes an assistance electronic station PE with a monitoring/control unit 8 connected to a camera 8 that overlies a deck 10.

As can be seen in FIGS. 1 to 4, said assistance station PE is preferably disposed between the merge table 7 and the sorting frame 4, and, in this example, the merge table is on the left of the station PE and the sorting frame 4 is on the right of said station PE.

The unit 8 is suitable for storing sorting data in a memory, and, in particular, it has, in its memory, the sorting data of the already-sorted mailpieces 3 that are disposed in a stack and on edge on the merge table 7. That sorting data may have been transferred from a postal sorting machine. In addition, the unit 8 has, in its memory, a sorting plan that is the sorting plan of the mailpieces 3.

In accordance with the invention, this assistance electronic station PE has two operating modes, one being referred to as the "frame sort mode", in which it provides assistance to the operative for sorting using the sorting frame, which, in this example, is a vertical-slot frame, and the other being an operating mode referred to as the "merge mode", in which it provides assistance to the operative for inserting a postal article 2 into the stack of mailpieces 3.

For example, as in this example, these two operating modes of the station PE are triggered by the operative by touching a key on the screen 11, which is a touch screen.

In the "frame sort" operating mode, the unit 8 is arranged to use the camera 9 to form an image of the article 2A on the top of the stack of articles 2 that is placed flat on the deck 10, and, on the basis of an image of said postal article 2A placed flat, which image contains a delivery address, to recognize said delivery address automatically, in particular by using optical character recognition (OCR) processing, and then, with the sorting plan in its memory, to identify a slot 5 in the sorting frame 4 where the postal article 2A is to be placed.

On the basis of this identification, the unit 8 causes a marker signal 12 to be displayed on the display screen 11, which marker signal is representative of the location of said slot in the sorting frame.

In FIG. 1, this signal 12 is the number of the slot in the frame, i.e. the number 2 in this example. It is possible to make provision for another type of display for identifying the location of the slot in the frame.

It can be understood that the location of the slot in the frame is identified essentially on the display screen 11 so that the frame may be a slot sorting frame of very simple design and that does not have any embedded electronics.

As shown in FIG. 1, the postal article 2A is inserted on edge as indicated by arrow F2 into a vertical slot 5 in the sorting frame 4.

The unit 8 is arranged so that a marker signal 12 is produced automatically as an article 2A is picked up from the top of the stack of articles 2, as shown in FIG. 1.

In the "merge" operating mode, the unit 8 is arranged to use the camera 9 to form a digital image of the article 2B on the top of the stack of articles 2 that is placed flat on the deck 10 of the station PE.

Then, on the basis of the image containing the delivery address of the article 2B, the unit 8 is arranged to recognize said delivery address automatically, in particular by OCR, and then, on the basis of the recognized delivery address, on the basis of the sorting data of the mailpieces 3, and on the basis of the sorting plan of the postal articles 2, the unit 8 is suitable for identifying a location in the stack of mailpieces 3 where the postal article 2B is to be inserted.

In addition, in this second operating mode, the unit 8 is suitable for displaying on the screen 11 a marker signal 13 representative of said location, which signal is specifically a number that, in this example, is the number 10 that is displayed on the bottom right of the screen, and that is the number of mailpieces to pass starting from the start of the stack in order to reach the insertion location.

In addition, the marker signal 13 may indicate, where applicable, the number of consecutive articles (the number 1 in this example on the top left of the screen 11) to be inserted at the merge location.

Figure 3:
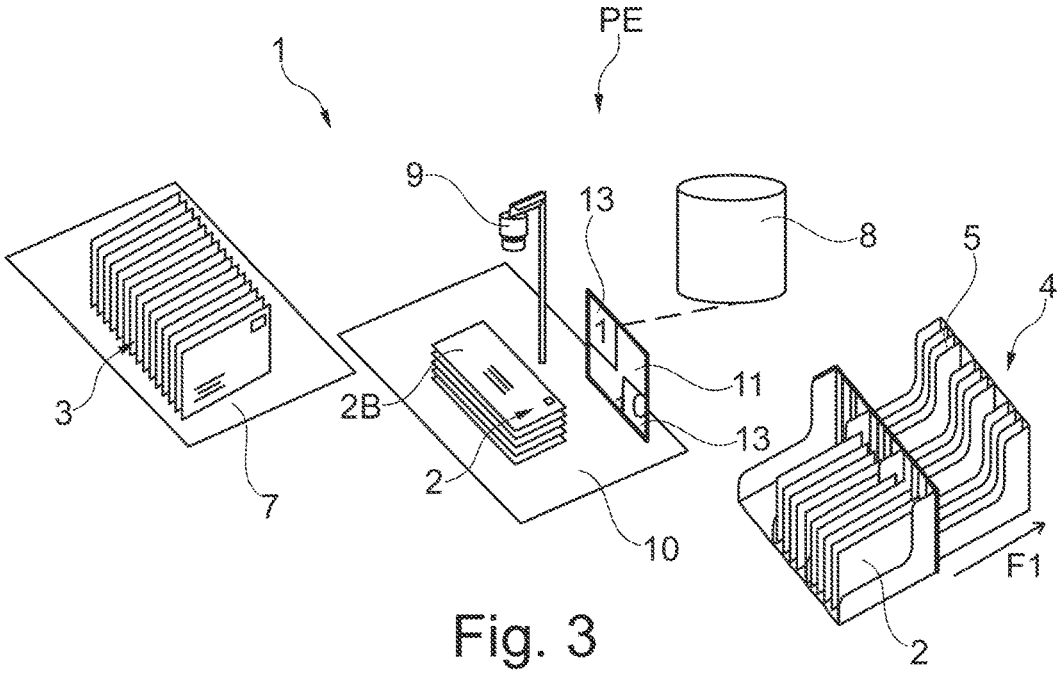

The monitoring/control unit 8 is designed so that a marker signal 13 is produced automatically as an article 2B is picked up from the top of the stack of articles 2, as shown in FIG. 3. Every time an image of an article 2B is formed and every time the delivery address is recognized automatically, the unit 8 may be designed to check whether said article 2B is indeed the object that is expected in the sequence of articles that have been frame-sorted.

If it is not, the unit 8 may be arranged to display an error message on the screen 11.

For example, an error may arise if an article to be merged has been left in a slot when it should have been picked up in a handful taken by the operative.

When the marker signal 13 is displayed on the screen 11, the operative scans through the stack of mailpieces 3 until the merge location is reached, then forms an insertion slot between two adjacent mailpieces, and then picks up the article 2B and inserts it into the insertion slot.

The unit 8 is arranged to act automatically to form a new image of the article 2B on the top of the stack, and to display a new marker signal 13 on the display screen 11.

Figure 5:
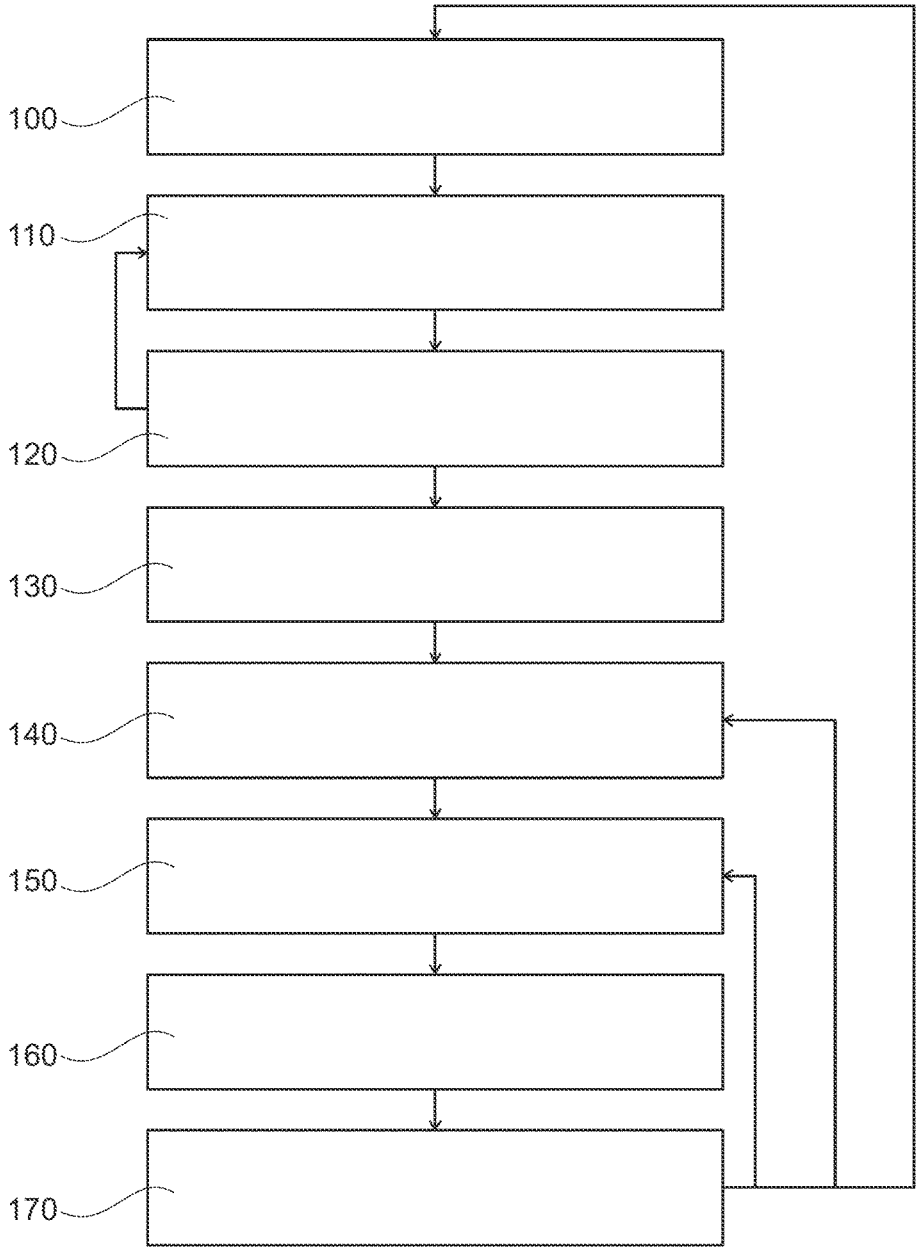
FIG. 5 is a flow chart showing the main steps of the merging method of the invention.

FIG. 5 shows the successive steps of an operation for merging postal articles with mailpieces that are already sorted, e.g. for the delivery round, by using the apparatus 1 of the invention.

In step 100, the operative places the already-sorted mailpieces in a stack and on edge on the merge table 7. The operative then places postal articles to be merged in a stack and flat on the deck 10 of the assistance electronic station PE as shown in FIG. 1.

In step 110, the operative activates the monitoring/control unit 8 of the assistance electronic station in a "frame sort" operating mode. In this operating mode, the assistance electronic station displays on the screen 11 a marker signal 12 that designates a slot 5 in the frame where the article 2 on the top of the stack of articles to be merged should be inserted.

In step 120, the operative picks up the article 2 on the top of the stack and inserts it into the slot in the sorting frame that is designated on the screen, and the process loops back to step 110.

The steps 110 and 120 are repeated until there is no longer any article on the deck 10 of the assistance electronic station PE. All of the postal articles to be merged are then in the slots 5 of the frame, as shown in FIG. 2 and the process continues at step 130.

In step 130, the operative can manipulate the slot frame 4 to retract the slot separators at regular intervals, thereby defining, in the slot frame, larger slots, each of which contains a plurality of postal articles 2 that form bundles of postal articles. Each of these bundles of postal articles may be picked up as a respective handful by the operative, thereby making it possible to accelerate the merge process.

In step 140, the operative then picks up a first handful of postal articles 2 from the frame, starting from one of the distal ends of the frame, and places those articles in a single action in a stack and flat on the deck 10 of the assistance electronic station PE.

The operative must ensure that the faces of the postal articles 2 that bear their delivery addresses are facing the camera 9 of the station PE.

In step 150, the operative activates the monitoring/control unit 8 of the assistance electronic station PE in a "merge" operating mode. In this operating mode, the assistance electronic station PE displays on the screen 11 a marker signal 12 that designates a merge location in the stack of mailpieces on edge placed on the merge table 7, as shown in FIG. 3, for inserting a postal article to be merged at said location.

Then, in step 160, the operative scans through the stack of mailpieces on edge to find the merge location, with the assistance of the marker signal displayed on the screen 11. When the merge location is found, the operative forms an insertion slot between two adjacent mailpieces.

Figure 4:
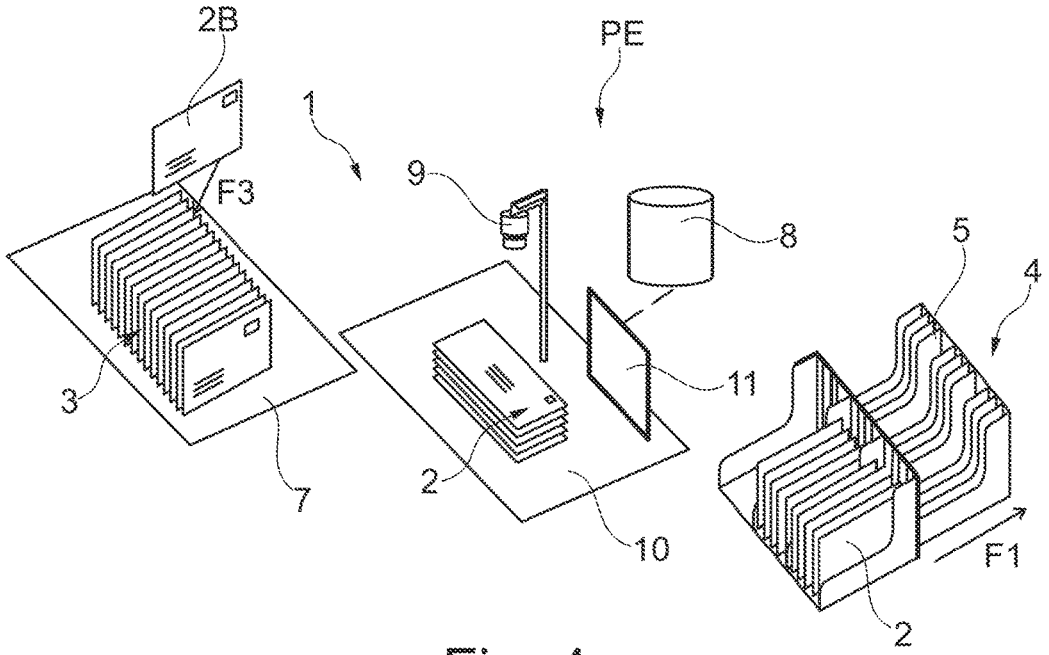

Then the process continues at step 170, in which the operative picks up the postal article 2 on the top of the stack in the assistance station PE and comes to place it on edge in the slot indicated by arrow F3 in FIG. 4.

Then the process loops back to step 150 and repeats steps 160 and 170 until there are no more articles to be merged in the assistance electronic station PE.

If the "merge" operating mode is triggered again, and if any postal articles 2 remain in the frame, the operative can, once again, place another handful of postal articles to be merged in a stack and flat on the deck 10 of the assistance electronic station PE. The process then loops again through the steps 140 to 170.

When no more postal articles 2 remain in the frame, the operative deactivates the "merge" operating mode, and reinitializes the process of the unit 8. The operative can thus start the method of merging on a table again, for merging with another stack of already-sorted mailpieces starting again from step 100.

What is claimed is:

1. A method of merging, on a table, postal articles with mailpieces that are already sorted, comprising the following steps:

placing the mailpieces in a stack and on edge on a merge table;

placing the postal articles to be merged with the mailpieces in a stack and flat on a deck of an assistance electronic station for assisting with manual sorting, which station comprises a camera disposed overlying the deck, a display screen, and a monitoring/control unit;

causing the monitoring/control unit of the station to operate in such a manner that, before each time a postal article is taken from the top of the stack of postal articles, a digital image of said article is formed by the camera, and, on the basis of said image, the unit produces, on the display screen, a first marker signal that designates a vertical slot in a sorting frame, into which slot said postal article is to be inserted;

when the vertical slots of the sorting frame are filled with postal articles, taking a bundle of postal articles, as a handful, from the sorting frame, and placing the bundle in a stack and flat on the deck of the assistance electronic station for assisting with manual sorting; and causing the monitoring/control unit of the station to operate in such a manner that, before each time a postal article is taken from the top of the bundle of postal articles previously stacked on the deck of the assistance electronic station, and, on the basis of said image, the unit produces, on the display screen, a second marker signal that is representative of an insertion position in the stack of mailpieces on the merge table, at which position said postal article is to be merged.

2. The method according to claim 1, further comprising a step in which the walls of the frame having vertical slots are retracted at regular intervals to constitute bundles of postal articles in the frame having slots.

* * * * *